US012409963B2

(12) United States Patent
Wagner, Jr. et al.

(10) Patent No.: US 12,409,963 B2
(45) Date of Patent: Sep. 9, 2025

(54) METHOD FOR PACKAGING A PACK COMMODITY, AND PACKAGE FOR A PACK COMMODITY

(71) Applicant: Felix Waldner GmbH, Linz (AT)

(72) Inventors: Hugo Wagner, Jr., Linz (AT); Hugo Wagner, Sr., Linz (AT)

(73) Assignee: Felix Waldner GmbH, Linz (AT)

( * ) Notice: Subject to any disclaimer, the term of this patent is extended or adjusted under 35 U.S.C. 154(b) by 139 days.

(21) Appl. No.: 18/045,892

(22) Filed: Oct. 12, 2022

(65) Prior Publication Data

US 2023/0120189 A1 Apr. 20, 2023

(30) Foreign Application Priority Data

Oct. 15, 2021 (EP) ..... 21202861

(51) Int. Cl.

| | |
|---|---|
| ***B65D 75/00*** | (2006.01) |
| ***B65B 11/50*** | (2006.01) |
| ***B65B 11/58*** | (2006.01) |
| ***B65B 13/02*** | (2006.01) |
| ***B65B 51/02*** | (2006.01) |
| ***B65D 71/00*** | (2006.01) |
| ***B65D 75/30*** | (2006.01) |

(52) U.S. Cl.

CPC ..... *B65B 11/585* (2013.01); *B65B 11/50* (2013.01); *B65B 13/02* (2013.01); *B65B 51/02* (2013.01); *B65D 71/0088* (2013.01); *B65D 2571/00018* (2013.01)

(58) Field of Classification Search

None

See application file for complete search history.

(56) References Cited

U.S. PATENT DOCUMENTS

| | | | | |
|---|---|---|---|---|
| 2,895,608 | A * | 7/1959 | Wilson | B65D 71/0092 206/820 |
| 4,432,185 | A | 2/1984 | Geisinger | |
| 5,450,965 | A | 9/1995 | Cox | |
| 5,813,536 | A * | 9/1998 | Bartholomew | B65D 71/0092 206/451 |
| 9,856,062 | B2 * | 1/2018 | Wagner, Sr. | B65B 51/02 |

(Continued)

*Primary Examiner* — Tanzim Imam

(74) *Attorney, Agent, or Firm* — Maginot, Moore & Beck

(57) ABSTRACT

A method for packaging a pack commodity comprises: providing a support element having an upper side, a lower side and side surfaces; placing a first packaging material sheet on the upper side; arranging the pack commodity on the first packaging material sheet such that a portion of the first packaging material sheet lies between the support element and the pack commodity and that with parts of the first packaging material sheet protruding beyond the pack commodity; placing a second packaging material sheet on an upper side of the pack commodity such that parts of the second packaging material sheet protrude beyond the pack commodity; folding the protruding parts so that they overlap along an overlapping portion on the side surfaces of the support element; applying a peripheral angular contact-pressure device laterally to the overlapping portion and to the upper side of the second packaging material sheet; and bracing the angular contact-pressure device by applying tension straps to generate a contact pressure in the overlapping portion.

10 Claims, 6 Drawing Sheets

(56) References Cited

U.S. PATENT DOCUMENTS

| | | | | |
|---|---|---|---|---|
| 2002/0023412 | A1* | 2/2002 | Usui | B65D 71/0096 53/447 |
| 2011/0302885 | A1 | 12/2011 | Tousek | |
| 2012/0047853 | A1* | 3/2012 | Harkonen | B32B 5/022 53/461 |
| 2012/0292221 | A1* | 11/2012 | Kruelle | B65D 71/0088 428/167 |
| 2015/0239639 | A1 | 8/2015 | Wenner et al. | |
| 2016/0340102 | A1* | 11/2016 | Barnitz | B65D 63/10 |

* cited by examiner

METHOD FOR PACKAGING A PACK COMMODITY, AND PACKAGE FOR A PACK COMMODITY

PRIORITY CLAIM

This application claims priority to European Application No. EP 21202861, filed on Oct. 15, 2021. The entire contents of the above-mentioned European patent application is incorporated herein by reference as part of the disclosure of this U.S. application.

BACKGROUND

The present invention relates to a method for packaging a pack commodity, in particular a commodity stack formed with a plurality of commodity pieces. Furthermore, the invention relates to a package for a pack commodity.

Although the present invention can be used in conjunction with a very wide variety of commodities and goods to be packaged, the present invention and the problems on which it is based are explained in more detail below with reference to the packaging of a commodity stack in the form of a sheet stack formed from individual metal sheets stacked one above the other.

If a stack of metal sheets placed one on top of the other is transported from the manufacturer or dealer to a customer or if the stack has to be stored beforehand, it is desirable to protect the metal sheets stacked one on top of the other from dirt and, in particular, moisture during transport or storage to ensure that the goods reach the customer in a state of perfect quality. In the case of metal sheets, the sheets should, in particular, be prevented from starting to corrode. In the case of galvanized steel sheets or objects, the aim is, for example, to avoid the formation of unsightly white rust on their surface. In order to prevent the entry of dirt and moisture, the sheet stack can be surrounded by an airtight packaging sleeve in order to prevent the entry of moist air masses from the storage or transport environment.

DE 35 21 416 A1 describes a method for the tight packaging of a commodity stack on a pallet. In this method, a shrink hood drawn over the stack of material is shrunk progressively in the vertical direction using hot gas. Finally, the shrink hood is tightly welded to a film that is present between the commodity stack and the pallet and that projects over the edge of the pallet.

EP 2 592 006 B1 discloses a method for packaging a pack commodity, in particular a commodity stack formed with a plurality of commodity pieces, which has the following steps:

- providing a support element, in particular a pallet, for supporting the pack commodity;
- placing a first packaging material sheet on the support element;
- arranging the pack commodity on the first packaging material sheet in such a way that a portion of the first packaging material sheet comes to lie between the support element and the pack commodity and that the first packaging material sheet protrudes beyond the pack commodity;
- placing a second packaging material sheet on an upper side of the pack commodity in such a way that the second packaging material sheet protrudes beyond the pack commodity; and
- connecting the first packaging material sheet to the second packaging material sheet in some region or regions. In the case of region-wise joining, the first packaging material sheet and the second packaging material sheet are adhesively joined in a respective, predetermined first region along a first portion of a periphery of the support element, such that they can be separated and, in particular, can be re-joined. In particular, an adhesive joint is proposed for the adhesive joining of the first packaging material sheet and the second packaging material sheet.

It has been found to be disadvantageous in the known method that an adhesive joint can be produced only with great difficulty and expense in a fully automated installation.

SUMMARY

It is therefore the object of the present invention to specify a method which makes it possible to package a pack commodity in such a way that, on the one hand, the pack commodity is protected against the ingress of dirt and moisture and, on the other hand, the package can be produced easily in a fully automated manner. It is furthermore the object of the present invention to provide a corresponding package for a pack commodity.

This object is achieved by means of a method for packaging a pack commodity having the features disclosed herein and by means of a package for a pack commodity having the features disclosed herein.

The concept of the present invention consists in folding the second packaging material sheet over the first packaging material sheet so that they overlap along an overlapping portion on the side surfaces of the support element, in applying a peripheral angular contact-pressure device laterally to the overlapping portion and, in some regions, to the upper side of the second packaging material sheet, and in bracing the angular contact-pressure device by applying one or more tension straps to generate a contact pressure in the overlapping portion.

It is thus possible to produce a pack commodity which is protected on all sides against environmental influences and can easily be produced in a fully automated manner without the packaging material sheets having to be additionally processed. Moreover, the peripheral angular contact-pressure device serves as a full-surface lateral edge protection which provides protection against an external influence of force on the pack commodity, e.g. against an impact of the forks of a fork-lift truck.

In a preferred development, the first packaging material sheet has an adhesive layer on a region of its side facing the upper side of the support element and is placed on the upper side in a releasably adhesive manner via the adhesive layer. This prevents possible slipping when the pack commodity is placed on top.

In a further preferred development, the first packaging material sheet has an adhesive layer on its entire side facing the upper side of the support element, and the protruding parts of the first packaging material sheet are folded onto the side surfaces of the support element in a releasably adhesive manner via the adhesive layer. This enables subsequent bonding to the second packaging material sheet.

In a further preferred development, the tension straps and the angular contact-pressure device are removed, the protruding parts of the first packaging material sheet are folded over away from the side surfaces of the support element and so as to bear against the pack commodity, such that the adhesive layer faces away from the pack commodity, and an adhesive region is formed between the folded-over protruding parts of the first packaging material sheet and the protruding parts of the second packaging material sheet. In this way, it is easy to achieve subsequent bonding.

In a further preferred development, the angular contact-pressure device is of one-piece design. This enables a particularly stable package.

In a further preferred development, the angular contact-pressure device is formed in multiple parts from a plurality of angular contact-pressure elements, wherein the angular contact-pressure elements are applied in such a way that they form overlap regions on the upper side of the second packaging material sheet, and wherein tension straps are fitted in such a way that they pass over the overlap regions. In this way, the angular contact-pressure elements can stabilize each other.

In a further preferred development, the support element has four rectangularly arranged side surfaces, wherein the tension straps are applied around the support element and the angular contact-pressure elements only on two opposite side surfaces. In this way, stabilization is possible with little effort.

In a further preferred development, the angular contact-pressure device is formed in multiple parts from a plurality of angular contact-pressure elements, wherein the angular contact-pressure elements are applied in such a way that they form abutting regions on the upper side of the second packaging material sheet, and wherein tension straps are fitted in such a way that they pass over the abutting regions. This likewise enables robust stabilization.

In a further preferred development, the support element has four rectangularly arranged side surfaces, wherein the tension straps are applied around the support element and the angular contact-pressure elements in each case on two opposite side surfaces. This likewise enables particularly robust stabilization.

In a further preferred development, the angular contact-pressure device has one or more projections, which are arranged in such a way that they are directed towards the second packaging material sheet in the overlapping portion. In this way, the lateral contact pressure can be increased.

In a further preferred development, the angular contact-pressure device is of acute-angled configuration and the acute angle is directed towards the pack commodity. In this way, it is likewise possible to increase the lateral contact pressure.

The present invention is explained in greater detail below with reference to the exemplary embodiments indicated in the schematic figures of the drawing.

DESCRIPTION OF THE FIGURES

In the figures.

In the figures of the drawing, identical reference signs denote identical or functionally identical elements and features, unless otherwise indicated.

DETAILED DESCRIPTION

Figure 1A:
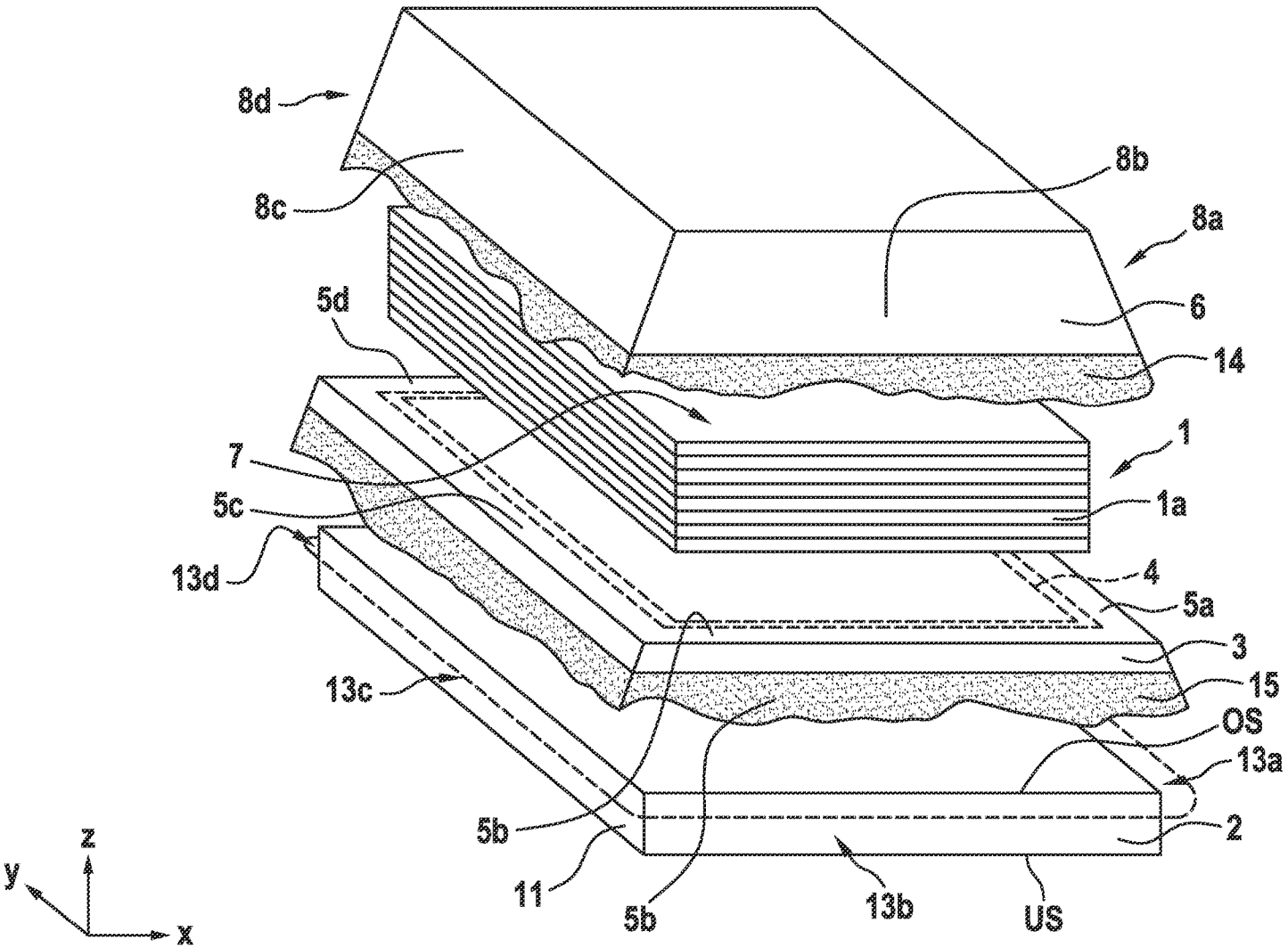
FIGS. 1*a*)-*c*) show schematic illustrations of successive method stages of a method for packaging a pack commodity according to a first embodiment of the present invention, more specifically FIG. 1*a*) in exploded view and FIG. 1*b*) and FIG. 1*c*) in cross-sectional view.
Figure 1B:
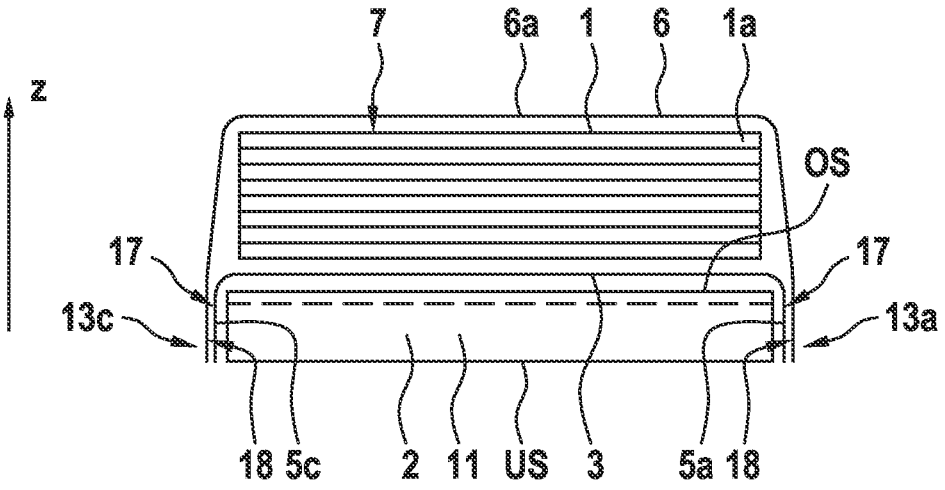
Figure 1C:
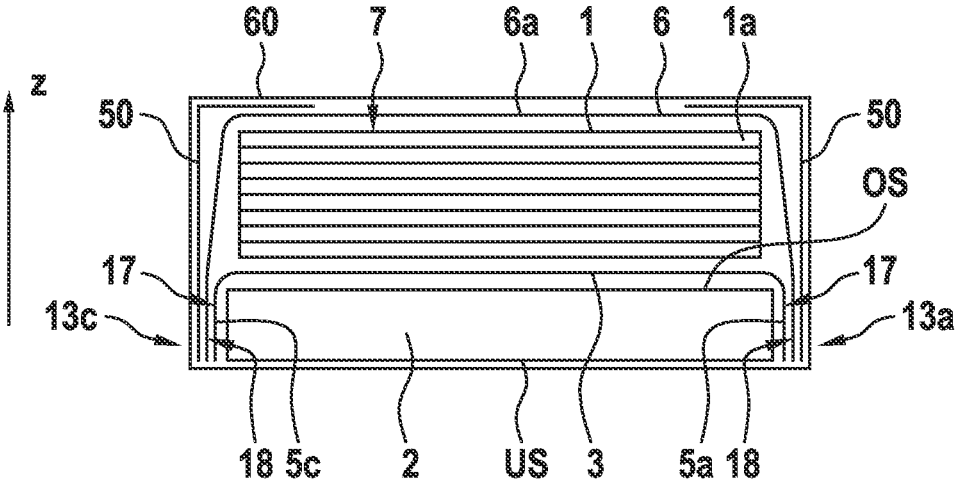

FIGS. 1*a*)-*c*) show schematic illustrations of successive method stages of a method for packaging a pack commodity according to a first embodiment of the present invention, more specifically FIG. 1*a*) in exploded view and FIG. 1*b*) and FIG. 1*c*) in cross-sectional view.

In order to package the pack commodity 1, which is illustrated in FIG. 1*a*) as a commodity stack formed with a plurality of commodity items 1*a*, of which for the sake of clarity only one is provided with a reference sign, for example a plurality of metal sheets of the same type, a support element 2 is first of all made available. In the first embodiment, both the pack commodity 1 and the support element 2 are of substantially rectangular design and are aligned in a corresponding manner with respect to one another during packaging.

The support element 2 serves to carry the pack commodity 1 and may, in particular, comprise a pallet, for example made of plastic, wood, metal or some other suitable material. It has an upper side OS, a lower side US and peripheral side surfaces 13*a*, 13*b*, 13*c*, 13*d* and is of rectangular design.

A first packaging material sheet 3 is then placed on the upper side OS of the support element 2, for example from above when viewed along a vertical direction Z, as depicted in FIG. 1. The first packaging material sheet 3 can be, for example, a sheet of plastic-coated and preferably fibre-reinforced paper or a plastic film of suitable thickness and tear strength.

The pack commodity 1 is then arranged on the first packing material sheet 3. For this purpose, the pack commodity 1 can be placed as a complete commodity stack on the first packing material sheet 3 resting on the support element 2, or the commodity pieces 1*a* can be placed individually. The pack commodity 1 is placed in such a way that it does not project laterally beyond the support element 2.

After the pack commodity 1 has been arranged on the first packaging material sheet 3, a portion 4 of the first packaging material sheet 3, indicated in FIG. 1 by a double dashed-line border, is located between the pack commodity 1 and the support element 2. Parts 5*a*-5*d* of the first packaging material sheet 3 protrude beyond the pack commodity 1. In addition, the parts 5*a*-5*d* can hang down laterally over the side surfaces 13*a*, 13*b*, 13*c*, 13*d* of the support element 2.

In a next step, a second packaging material sheet 6, which can be formed from the same material as the first packaging material sheet 3, is placed on an upper side 7 of the pack commodity 1. In this case, parts 8*a*-8*d* protrude beyond the pack commodity 1 and can hang down laterally from the upper side 7 of the pack commodity 1 over the side surfaces 13*a*, 13*b*, 13*c*, 13*d* of the support element 2.

The second packaging material sheet 6 can also be formed, for example, by a plastic-coated and preferably fibre-reinforced paper or by a plastic film. The two packaging material sheets 3 and 6 can, as desired, be transparent or non-transparent or can also be printed with information or handling instructions or the like.

The second packaging material sheet 6 is then folded over the first packaging material sheet 3 in an overlapping manner in some regions. This overlapping folding takes place along an overlapping portion 11 of a substantially entire periphery of the support element 2, which lies on the side surfaces 13*a*, 13*b*, 13*c*, 13*d* thereof. This loosely overlapping folded joint is non-adhesive and is supported at most by material-specific cohesion forces.

In the first exemplary embodiment shown, the overlapping portion 11 extends approximately along the vertical 75 to 90 percent of the side surfaces 13*a*, 13*b*, 13*c*, 13*d*, substantially over the entire periphery of the support element 2. In practice, an overlap region of at least 5 to 10 cm has been found to be advantageous. Here, reference sign 14 denotes the outer overlapping portion of the second packaging material sheet 6, and reference sign 15 denotes the inner overlapping portion of the first packaging material sheet 3.

This overlap joint in the region 14, 15 is, on the one hand, not designed to be tight, for example with respect to the penetration of moist air, dust and water, but, on the other hand, is designed to be easy for the consumer to detach subsequently, more specifically, in particular, in such a way that the two packaging material sheets 3 and 6 can be easily detached from one another by hand along the overlapping portion 11 to open the package after or during transport or storage. In other words, one person can pull the two packaging material sheets 3, 6 adhering to one another in the first region 14 off one another with a manual effort which is easy to manage. Thus, no knives or the like are necessary in order to gain access to the packaged pack commodity 1. However, an additional measure must be taken for transport in order to achieve the required tightness.

FIG. 1*b*) illustrates the method stage according to FIG. 1*a*) in cross-sectional view.

As shown in particular in FIG. 1*b*), the protruding part 5*c* of the first packaging material sheet 3 is folded downwards towards side surface 13*c* of the support element 2, while, on the opposite side of the support element 2, the protruding part 5*a* of the first packaging material sheet 3 is folded against side surface 13*a* of the support element 2.

As a result, in particular when the first packaging material sheet 3 is subsequently pressed sealingly together with the second packaging material sheet 6, an upper side 17 of the first packaging material sheet 3 can be held in sealing contact in an overlapping manner with a lower side 18 of the second packaging material sheet 6 in the first region 14 and in the second region 15. The same applies to the side surfaces 13*b*, 13*d* not illustrated in FIG. 1*b*).

FIG. 1*c*) shows a method stage which follows the method stage according to FIGS. 1*a*), *b*), namely a process of pressing the upper side 17 of the first packaging material sheet 3 in the first region 14 and the lower side of the second packaging material sheet 6 in the second region 15 onto one another along the overlapping portion 11 on the side surfaces 13*a*, 13*b*, 13*c*, 1*d* of the support element 2.

For this purpose, a peripheral one-piece angular contact-pressure device 50 is first of all placed laterally against the side surfaces 13*a*, 13*b*, 13*c*, 13*d* with the overlappingly folded packaging material sheets 3, 6 and, in some regions, against the upper side 6*a* of the second packaging material sheet 6, which, in the first embodiment, is of right-angled configuration.

This peripheral angular contact-pressure device 50 is configured in such a way that it covers the overlapping portion 11, in which the first packaging material sheet 3 and the second packaging material sheet 6 overlap, in an encircling manner at least partially in the z direction.

The contact pressure of the vertical legs of the angular contact-pressure device 50 which is required for sealingly pressing the upper side 17 of the first packaging material sheet 3 in region 15 and the lower side 18 of the second packaging material sheet 6 in the second region 14 onto one another along the overlapping portion 11 on the side surfaces 13*a*, 13*b*, 13*c*, 13*d* of the support element 2 is produced by one or more tension straps 60 being fitted around the support element 2 and the angular contact-pressure device 50.

Illustrative materials for the angular contact-pressure device 50 are metal, in particular steel or aluminium, plastic and hard cardboard. Illustrative materials for the tension straps 60 are metal, in particular steel, and plastic.

It is thereby possible to achieve a combination which prevents the penetration of moist air, dust and water but is designed to be easily released subsequently by the consumer.

As can be seen from FIGS. 1*a*) to *c*), the pack commodity 1 and the support element 2 are of substantially rectangular design here in plan view by way of example, but the method according to the invention can also be used in the case of support elements and pack commodities of a different shape and, in particular, can also be used for packaging a pack commodity which is of a very irregular shape, for example metal sheets with an outer edge cut to any desired shape, on a pallet which is substantially rectangular in plan view.

In the region of the corners of the support element 2 and depending on the shape of the pack commodity 1, folds can occur in the region of the corners of the pack commodity 1 due to excess material. However, such folds are not troublesome since they are likewise compressed in the case of the one-piece angular contact-pressure device 60 as used in this first embodiment.

Figure 2A:
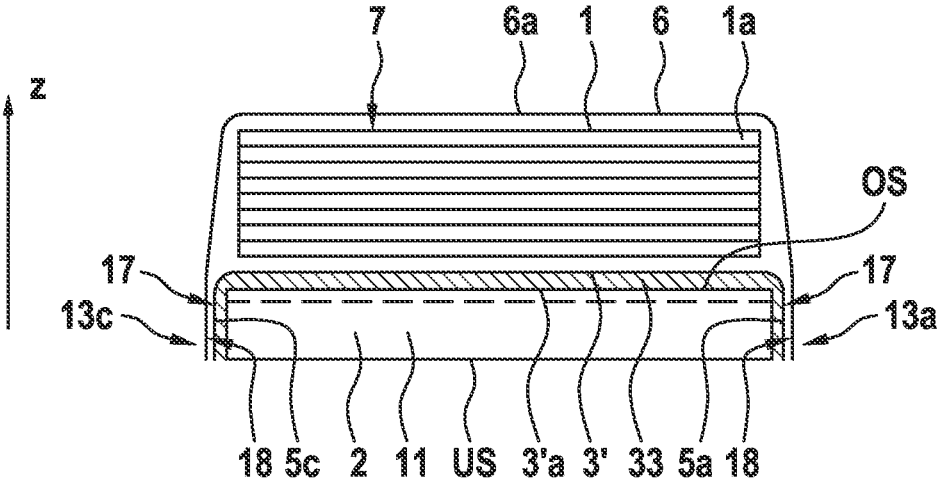
FIGS. 2*a*), *b*) show schematic illustrations of a pack commodity according to a second embodiment of the present invention, more specifically FIG. 2*a*) and FIG. 2*b*) in cross-sectional view.
Figure 2B:
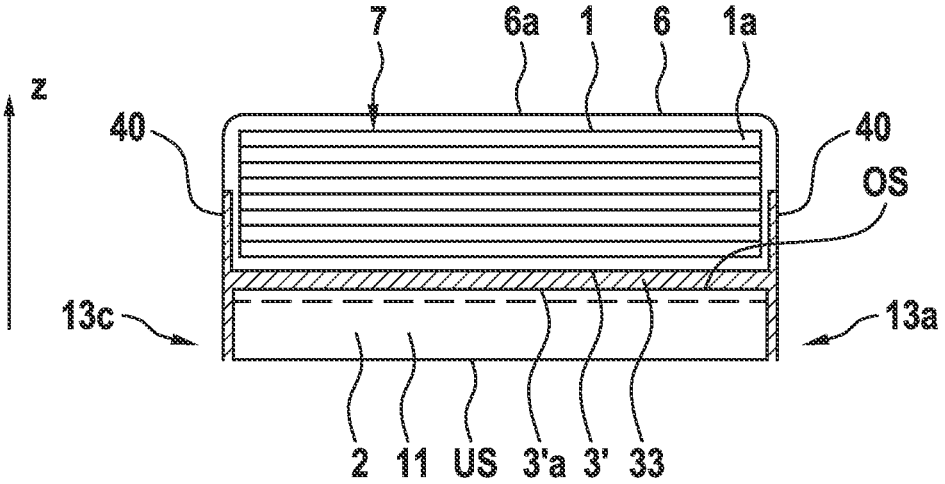

FIGS. 2*a*), *b*) show schematic illustrations of a pack commodity according to a second embodiment of the present invention, more specifically FIG. 2*a*) and FIG. 2*b*) in cross-sectional view.

In the second embodiment, the first packaging material sheet 3' has an adhesive layer 33 on its entire side 3' facing the upper side OS of the support element. The protruding parts 5*a*, 5*b*, 5*c*, 5*d* of the first packaging material sheet 3' are folded onto the side surfaces 13*a*, 13*b*, 13*c*, 13*d* of the support element 2 in a releasably adhesive manner via the adhesive layer 33, as illustrated in FIG. 2*a*).

With reference to FIG. 2*b*), the tension straps 60 and the angular contact-pressure device 50 are removed after transport and delivery (cf. FIG. 1*c*). The protruding parts 5*a*, 5*b*, 5*c*, 5*d* of the first packaging material sheet 3' are then folded over away from the side surfaces 13*a*, 13*b*, 13*c*, 13*d* of the support element 2 into a state in which they rest against the pack commodity 1, with the result that the adhesive layer 33 faces away from the pack commodity 1.

Finally, reclosure is performed by forming an adhesive region 40 between the folded-over protruding parts 5*a*, 5*b*, 5*c*, 5*d* of the first packaging material sheet 3' and the protruding parts 8*a*, 8*b*, 8*c*, 8*d* of the second packaging material sheet 6.

In other respects, the second embodiment is identical to the first embodiment.

Figure 3:
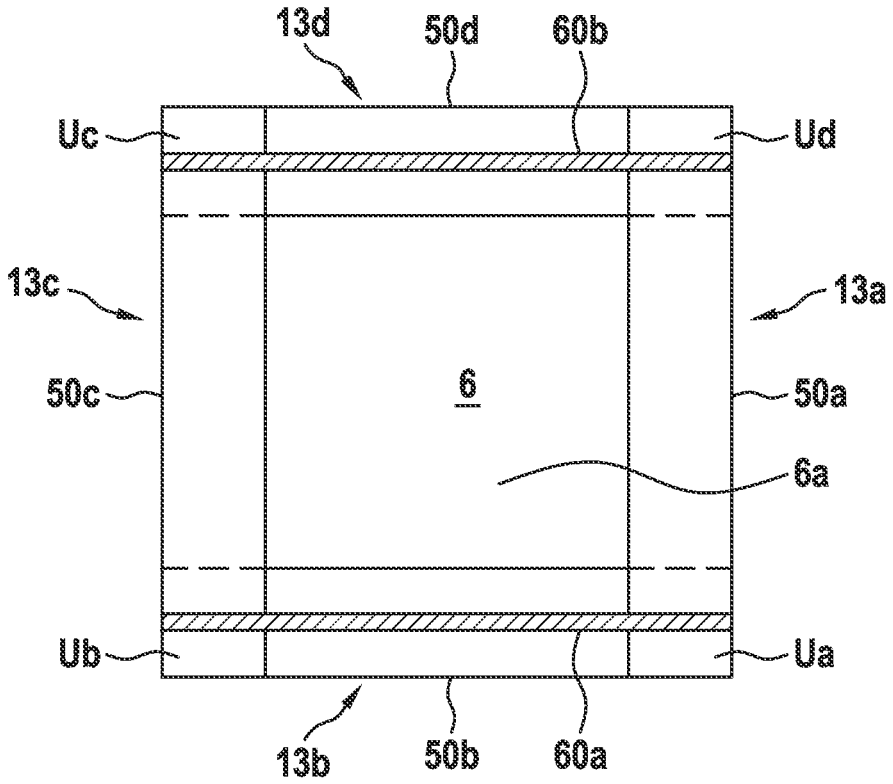
FIG. 3) shows a plan view of a pack commodity according to a third embodiment of the present invention.

FIG. 3) shows a plan view of a pack commodity according to a third embodiment of the present invention.

In the third embodiment, the angular contact-pressure device 50*a*-50*d* is constructed in several parts from a plurality of angular contact-pressure elements 50*a*-50*d*.

The angular contact-pressure elements 50*a*-50*d* are applied in such a way that they form overlap regions Ua-Ud on the upper side 6 of the second packaging material sheet 6. In the overlap regions Ua-Ud, the angular contact-pressure elements 50*a*, 50*c* lie above the angular contact-pressure elements 50*b*, 50*d*.

A first and a second tension strap 60*a*, 60*b* are fitted in such a way that they pass over the overlap regions Ua-Ud. The tension straps 60*a*, 60*b* are thus fitted around the support element 2 and the angular contact-pressure elements 50*a*-50*d* only on two opposite side surfaces 13*a*, 13*c*.

By virtue of the stabilization in the overlap regions Ua-Ud, however, this is sufficient for media-tight packaging of the pack commodity 1*a*.

In other respects, the third embodiment is identical to the first embodiment.

Figure 4:
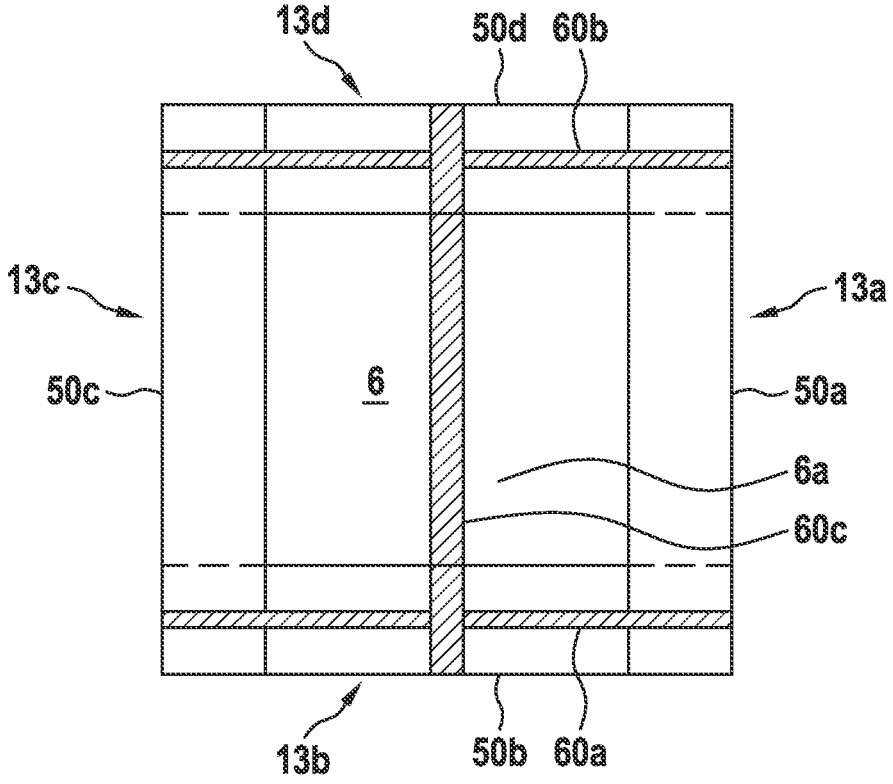
FIG. 4) shows a plan view of a pack commodity according to a fourth embodiment of the present invention.

FIG. 4) shows a plan view of a pack commodity according to a fourth embodiment of the present invention.

The fourth embodiment differs from the third embodiment in that a third tension strap 60*c* is fitted around the support element 2 and the angular contact-pressure elements 50*b*, 50*d* on the two opposite side surfaces 13*b*, 13*d*.

In this way, a particularly stable combination can be achieved.

In other respects, the fourth embodiment is identical to the first and third embodiments.

Figure 5:
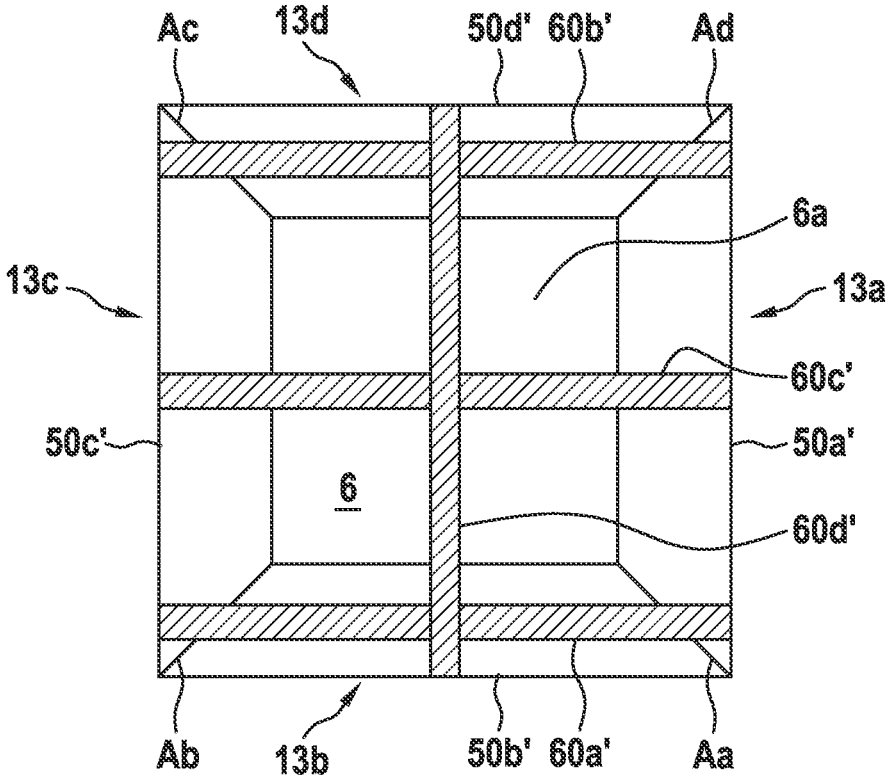
FIG. 5) shows a plan view of a pack commodity according to a fifth embodiment of the present invention.

FIG. 5) shows a plan view of a pack commodity according to a fifth embodiment of the present invention.

In the fifth embodiment, the angular contact-pressure device 50*a*'-50*d*' is likewise constructed in several parts from a plurality of angular contact-pressure elements 50*a*'-50*d*'.

The angular contact-pressure elements 50*a*'-50*d*' are applied and configured in such a way that they form abutting regions Aa-Ad on the upper side 6*a* of the second packaging material sheet 6.

A first and a second tension strap 60*a*', 60*b*' are fitted in such a way that they pass over the abutting regions Aa-Ad. A third and a fourth tension strap 60*c*', 60*c*' are passed over the angular contact-pressure elements 50*a*', 50*c*' and 50*b*', 50*d*', respectively.

In this way, a particularly stable combination can likewise be achieved.

In other respects, the fifth embodiment is identical to the first embodiment.

Figure 6:
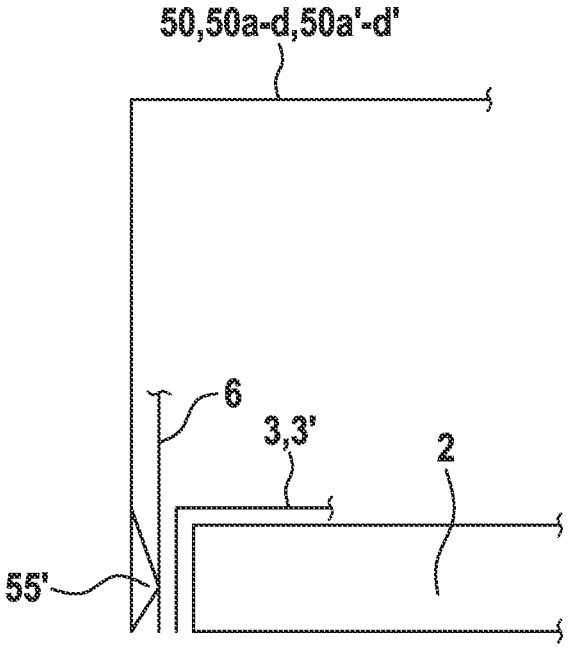
FIG. 6) shows a partial cross section of an angular contact-pressure device for a pack commodity according to a sixth embodiment of the present invention.

FIG. 6) shows a partial cross section of an angular contact-pressure device for a pack commodity according to a sixth embodiment of the present invention.

In the sixth embodiment, the angular contact-pressure device 50 or 50*a*-50*d* or 50*a*'-50*d*' has one or more projections 55, which are arranged in such a way that they are directed towards the second packaging material sheet 6 in the overlapping portion 11. This increases the lateral contact pressure and ensures particularly high tightness.

In other respects, the sixth embodiment is identical to the first to fifth embodiments.

Figure 7:
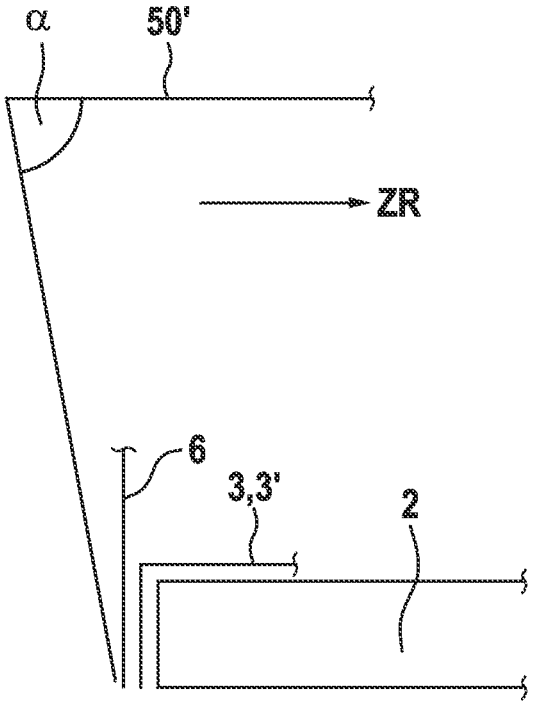
FIG. 7) shows a partial cross section of an angular contact-pressure device for a pack commodity according to a seventh embodiment of the present invention.

FIG. 7) shows a partial cross section of an angular contact-pressure device for a pack commodity according to a seventh embodiment of the present invention.

In the seventh embodiment, the angular contact-pressure device 50' is of acute-angled configuration and the acute angle $\alpha$ is directed towards the pack commodity 1. Bracing in the direction of tension ZR ensures particularly high tightness.

Such a configuration can be implemented in all embodiments.

In other respects, the seventh embodiment is identical to the first to sixth embodiments.

Although the invention has been described above with reference to preferred exemplary embodiments, it is not restricted thereto but can be modified in a variety of ways without departing from the subject matter of the present invention.

In particular, the present invention is not restricted to support elements in the form of rectangular pallets or to cuboidal pack commodities and commodity stacks. On the contrary, it is also possible for pack commodities of other shapes to be packaged on rectangular or differently shaped support elements or bases by means of the method according to the invention.

The invention claimed is:

1. A method for packaging a pack commodity, the method comprising the following steps:

providing a support element for supporting the pack commodity, said support element having an upper side, a lower side and side surfaces;

placing a first packaging material sheet on the upper side of the support element;

arranging the pack commodity on the first packaging material sheet in such a way that a portion of the first packaging material sheet comes to lie between the support element and the pack commodity and that parts of the first packaging material sheet protrude beyond the pack commodity;

placing a second packaging material sheet on an upper side of the pack commodity in such a way that part of the second packaging material sheet protrude beyond the pack commodity;

folding the protruding parts of the second packaging material sheet over the protruding parts of the first packaging material sheet so that they overlap along an overlapping portion on the side surfaces of the support element;

applying a peripheral angular contact-pressure device laterally to the overlapping portion, the peripheral angular contact-pressure device extending, in some regions, to an upper side of the second packaging material sheet; and bracing the peripheral angular contact-pressure device by applying one or more tension straps to generate a contact pressure in the overlapping portion, wherein the first packaging material sheet has an adhesive layer on an entirety of a side of the first packaging material sheet facing the upper side of the support element and is placed on the upper side of the support element in a releasably adhesive manner via the adhesive layer, and wherein the protruding parts of the first packaging material sheet are folded onto the side surfaces of the support element in a releasably adhesive manner via the adhesive layer.

2. Method according to claim 1, further comprising the steps of: removing the one or more tension straps and the peripheral angular contact-pressure device, folding over the protruding parts of the first packaging material sheet away from the side surfaces of the support element so that the protruding parts of the first packaging material sheet bear against the pack commodity, and so that the adhesive layer faces away from the pack commodity, and forming an adhesive region between the folded-over protruding parts of the first packaging material sheet and the protruding parts of the second packaging material sheet.

3. Method according to claim 1, wherein the peripheral angular contact-pressure device is of one-piece design.

4. Method according to claim 1, wherein the peripheral angular contact-pressure device is formed in multiple parts from a plurality of angular contact-pressure elements, wherein the angular contact-pressure elements are applied in such a way that they form overlap regions on the upper side of the second packaging material sheet, and wherein the one or more tension straps are fitted in such a way that they pass over the overlap regions.

5. Method according to claim 4, wherein the side surfaces of the support element include four rectangularly arranged side surfaces, and the one or more tension straps are applied around the support element and the angular contact-pressure elements only on two opposite side surfaces of the four rectangularly arranged side surfaces.

6. Method according to claim 1, wherein the angular contact-pressure device is formed in multiple parts from a plurality of angular contact-pressure elements, wherein the angular contact-pressure elements are applied in such a way that they form abutting regions on the upper side of the second packaging material sheet, and wherein the one or more tension straps are fitted in such a way that they pass over the abutting regions.

7. Method according to claim 6, wherein the side surfaces of the support element include four rectangularly arranged side surfaces, and the one or more tension straps are applied around the support element and the angular contact-pressure elements in each case on two opposite side surfaces of the four rectangularly arranged side surfaces.

8. Method according to claim 1, wherein the angular contact-pressure device has one or more projections which are arranged in such a way that they are directed towards the second packaging material sheet in the overlapping portion.

9. Method according to claim 1, wherein the angular contact-pressure device is of acute-angled configuration having an acute angle is directed towards the pack commodity.

10. A method for packaging a pack commodity, the method comprising the following steps:

providing a support element for supporting the pack commodity, said support element having an upper side, a lower side and side surfaces;

placing a first packaging material sheet on the upper side of the support element;

arranging the pack commodity on the first packaging material sheet in such a way that a portion of the first packaging material sheet comes to lie between the support element and the pack commodity and that parts of the first packaging material sheet protrude beyond the pack commodity;

placing a second packaging material sheet on an upper side of the pack commodity in such a way that part of the second packaging material sheet protrude beyond the pack commodity;

folding the protruding parts of the second packaging material sheet over the protruding parts of the first packaging material sheet so that they overlap along an overlapping portion on the side surfaces of the support element;

applying a peripheral angular contact-pressure device laterally to the overlapping portion, the peripheral angular contact-pressure device extending, in some regions, to an upper side of the second packaging material sheet; and bracing the peripheral angular contact-pressure device by applying one or more tension straps to generate a contact pressure in the overlapping portion, wherein the angular contact-pressure device is of acute-angled configuration having an acute angle directed towards the pack commodity.

* * * * *